US005211498A

United States Patent [19]

Huang

[11] Patent Number: 5,211,498

[45] Date of Patent: May 18, 1993

[54] FOLDING JOINT FOR A FOLDABLE PLAYYARD

[76] Inventor: Sieno T. M. Huang, No. 26, Lane 348, Ching Hu Tsun, Lin Kou Hsiang, Taipei Hsien, Taiwan

[21] Appl. No.: 818,885

[22] Filed: Jan. 10, 1992

[51] Int. Cl.[5] ..... F16C 11/10

[52] U.S. Cl. ..... 403/102; 403/85; 403/58; 403/117; 16/347; 5/99.1

[58] Field of Search ..... 403/102, 100, 85, 86, 403/58, 57, 113, 117; 16/343, 349, 376, 387, 374, 347; 5/99.1

[56] References Cited

U.S. PATENT DOCUMENTS

| | | | |
|---|---|---|---|
| 1,520,134 | 12/1924 | Mizer | 403/102 |
| 2,066,182 | 12/1936 | Lenz | 403/100 |
| 4,069,524 | 1/1978 | Carlo | 5/99.1 |
| 4,131,378 | 12/1978 | Daws | 403/93 |
| 4,357,735 | 11/1982 | Saint et al. | 5/99.1 X |
| 4,611,945 | 9/1986 | Diego | 403/102 X |
| 4,811,437 | 3/1989 | Dillner et al. | 5/99 |
| 4,881,776 | 11/1989 | Wang | 403/96 X |
| 4,934,025 | 6/1990 | Mariol | 16/347 |

*Primary Examiner*—Andrew V. Kundrat
*Assistant Examiner*—Harry C. Kim
*Attorney, Agent, or Firm*—Varndell Legal Group

[57] ABSTRACT

A folding joint for a foldable playyard having a base frame having two connecting members pivotably secured at the inside for holding two rails permitting them to be held in a longitudinally aligned position or folded up into a collapsed position. The connecting members each have an axial hole at one end for inserting either rail, two through holes on two opposite side walls thereof, and a track connected between the two through holes. The rails each have a pivot hole secured between the two through holes by a headed pin. The two rails are held in the longitudinally aligned position when the head of the headed pin is engaged in one through hole; and the two rails are allowed to be folded up when the head of the headed pin is rotated to the other through hole.

1 Claim, 5 Drawing Sheets

FOLDING JOINT FOR A FOLDABLE PLAYYARD

BACKGROUND OF THE INVENTION

The present invention relates to folding joints and relates more particularly to a folding joint for the folding frame of a children's playyard of the foldable type.

Several foldable playyards have been known. In U.S. Pat. No. 4,934,025, John V. Mariol disclosed a center fold playyard having hinges coupling the rails of the upper horizontal support thereof at intermediate locations. The hinges are adapted to be rotated about their axes between a locked position wherein the playyard is secured for operation and use and an unlocked position wherein the upper rails thereof may be pivoted and the entire playyard collapsed upon the raising of the hub thereof. According to John V Mariol's disclosure, each hinge is comprised of two mating halves having offset circular sections which are joined together centrally by a pivot pin. Because the two hinge halves of each hinge are supported on a pivot pin only, the hinges or the rails thereto may be caused to deform when the playyard is secured for operation.

In U.S. Pat. No. 4,811,437, James and et. al. disclosed another structure of foldable playyard which utilizes latch mechanisms and spring means to connect the rails thereof. This structure is not durable in use because the spring means may become ineffective due to the happening of elastic fatigue problem.

SUMMARY OF THE INVENTION

The present invention has been accomplished to eliminate the aforesaid disadvantages. According to one aspect of the present invention, a folding joint is generally comprised of a base frame having two connecting members pivotably secured at the inside for holding two rails permitting them to be held in a longitudinally aligned position or folded up into a collapsed position, wherein each connecting member has two through holes connected by a track; each rail has a pivot hole at one end inserted into an axial hole on either connecting member and secured between the two through holes on the connecting member by a headed pin. The two rails are held in a longitudinally aligned position when the head of the headed pin on either rail is engaged into one through hole on either connecting member. The two rails are allowed to be folded up when the head of the headed pin on either rail is rotated through the track to the other through hole on either connecting member. Because of the arrangement of the track, the head of the headed pin on either rail can be conveniently rotated from one through hole to the other and therefore, the rails can be rotated into the longitudinally aligned position or the collapsed position. According to another aspect of the present invention, the connecting members have curved, smooth top surface portions respectively fitting two curved bearing wall portions on the base frame to eliminate the concentration of stress.

DETAILED DESCRIPTION OF THE PREFERRED EMBODIMENT

Figure 1:
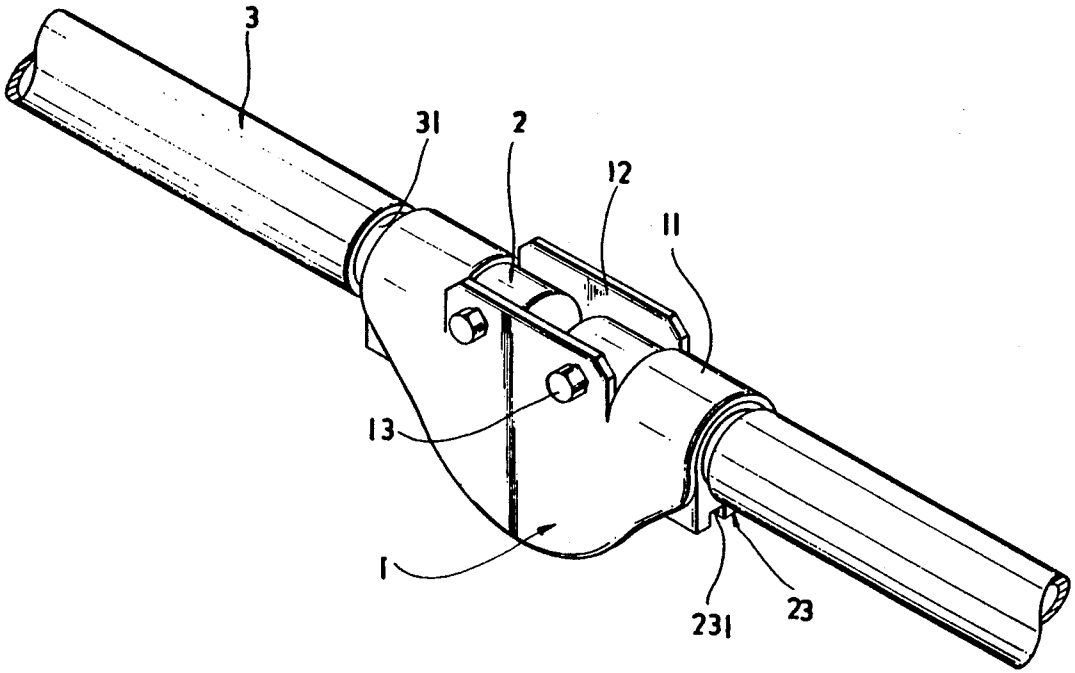
FIG. 1 is a perspective view of a folding joint embodying the present invention.
Figure 2:
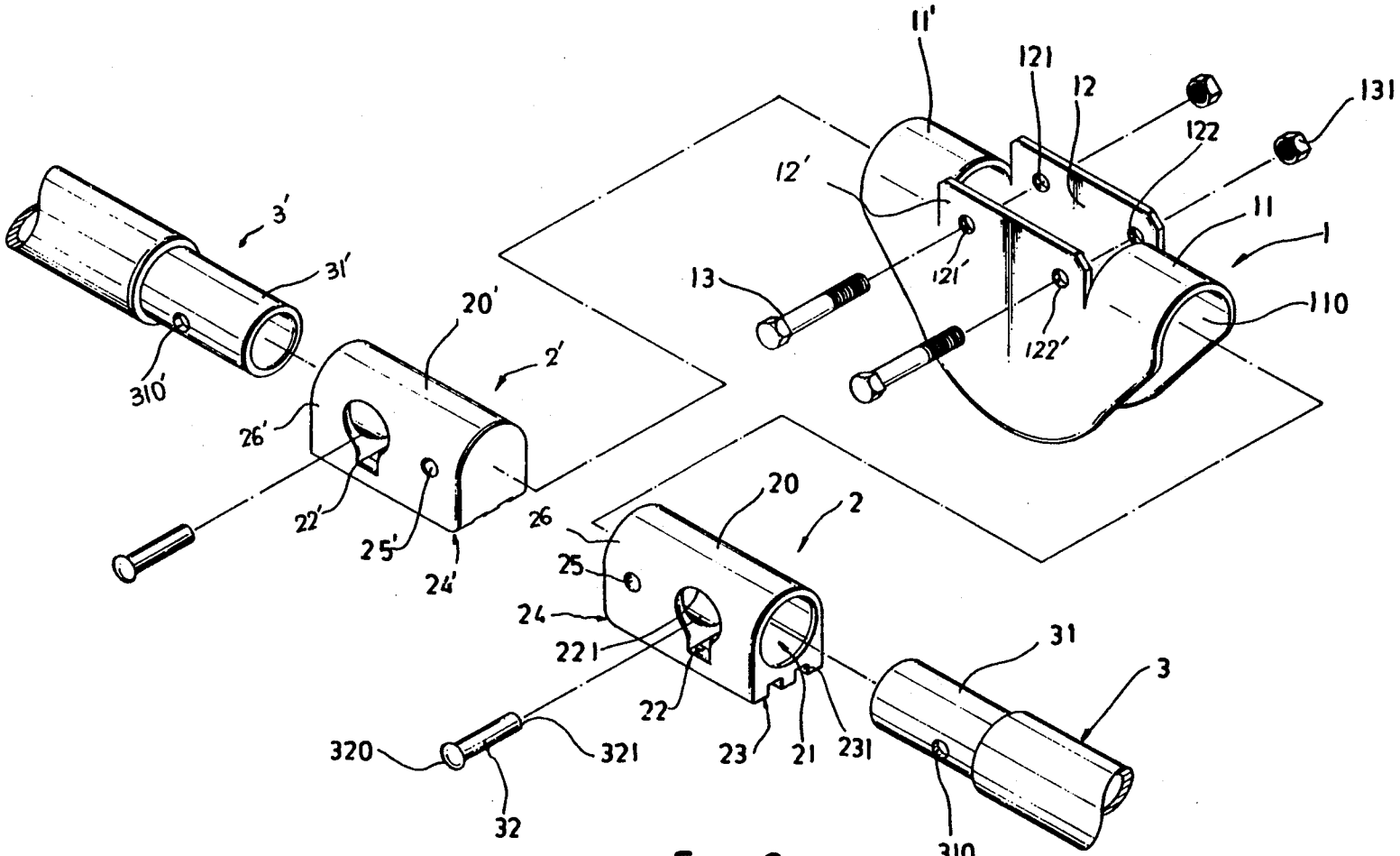
FIG. 2 is an exploded perspective view thereof.
Figure 3:
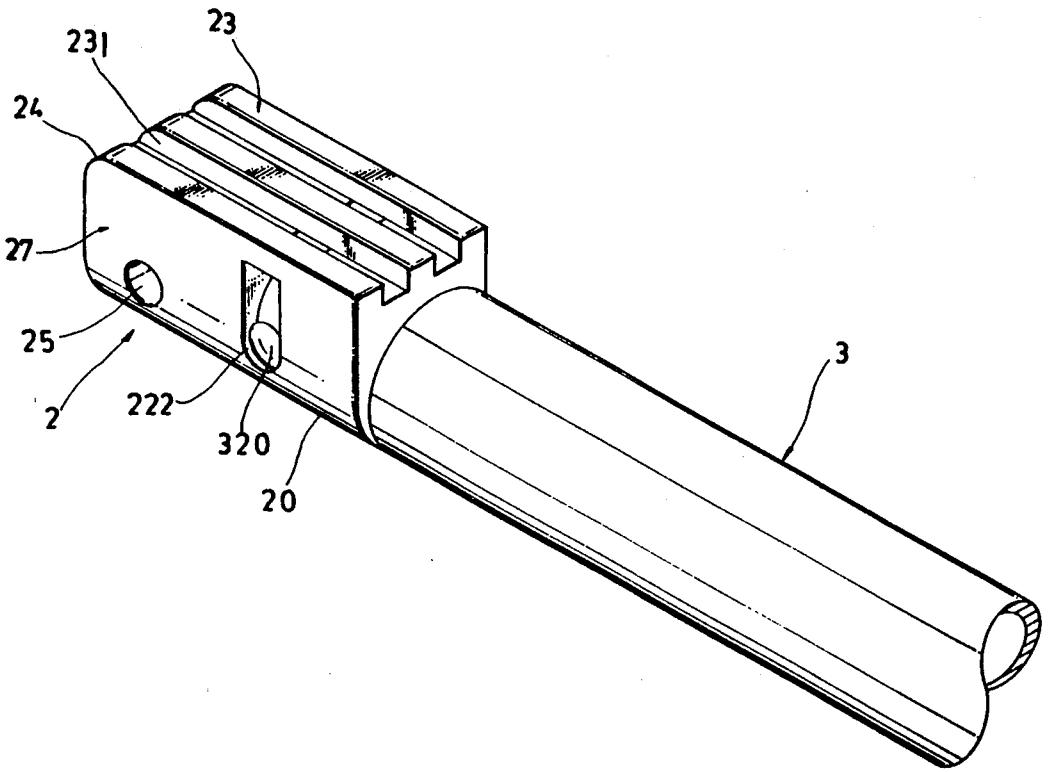
FIG. 3 is a perspective assembly view of a connecting member and a rail.

Referring to FIGS. 1, 2 and 3, a folding joint in accordance with the present invention is generally comprised of a base frame 1 having two connecting members 2, 2' pivotably received therein for holding two rails 3, 3' in longitudinally aligned positions. The base frame 1 is made from a plate in the shape of a riding saddle having two unitary, curved bearing wall portions 11, 11' two opposite ends with two curved receiving spaces 110, 110' (110' is not shown) defined therein and longitudinally aligned with each other for receiving the connecting members 2, 2', and two vertical flat wall portions 12 bilaterally connected between the two curved bearing wall portions 11, 11' for fastening the connecting members 2, 2'. The two vertical flat wall portions 12, 12' have through holes 121, 122, 121', 122' respectively aligned for securing the connecting members 2, 2' by screw bolts 13 and lock nuts 131. The connecting members 2, 2' are respectively made from a plastic material through the process of injection molding, of which each has a curved top surface portion 20 or 20' corresponding to either curved receiving space 110 or 110', an axial hole 21 or 21' at one end for inserting either rail 3, 3', a through hole 221 or 221' on one side surface portion 26 or 26' thereof, a through hole 222 or 222' on an opposite side surface portion 27 or 27' thereof aligned with the through hole 221 or 221', a track 22 or 22' connected between the through holes 221, 222 or 221', 222' through the axial hole 21 or 21' at the bottom, a plurality of grooves 231 longitudinally disposed on a flat bottom surface portion 23 thereof, a closed, chamfered end edge 24 or 24' at an opposite end, and a pivot hole 25 or 25' through the side surface portions 26, 27 or 26', 27' thereof secured between the through holes 121, 121' or 122, 122' by screw bolts 13 and lock nuts 131. The through hole 222 or 222' and the track 22 or 22' are respectively made in sizes suitable for passing the head 320 of a headed pin 32. The through hole 221 or 221' has an inner diameter slighter bigger than the outer diameter of the headed pin 32 but relatively smaller than the head 320 of the headed pin 32. The level of the through holes 221, 222 or 221' 222' is equal to the level of the center of the axial hole 21 or 21'. The rails 3, 3' each has a connecting end 31 or 31' at one end tightly fitting into the axial hole 21 or 21' on either connecting member 2 or 2'. The connecting end 31 or 31' has a pin hole 310 or 310' secured to the through hole 221 or 221' by a headed pin 32. Once the connecting end 31 of either rail 3 or 3' is connected to either connecting member 2 or 2' by a headed pin 32, the headed pin 32 has a terminal end 321 disposed in flush with the outer wall surface of the connecting end 31 or 31' and the head 320 of the head pin 32 is protruded beyond the outer wall surface of the connecting end 31 or 31', i.e., the terminal end 321 of the headed pin 32 does not stop the connecting end 31 or 31' from rotary motion relative to the connecting member 2 or 2' and, the head 320 of the headed pin 32 can be rotated inside the axial hole 21 or 21' through the track 22 or 22' within an angle of 180° between the through holes 221, 222 or 221' 222'. Because of the arrangement of the closed, chamfered end edge 24 or 24', the connecting member 2 or 2' can be smoothly rotated in the base frame 1.

Figure 4:
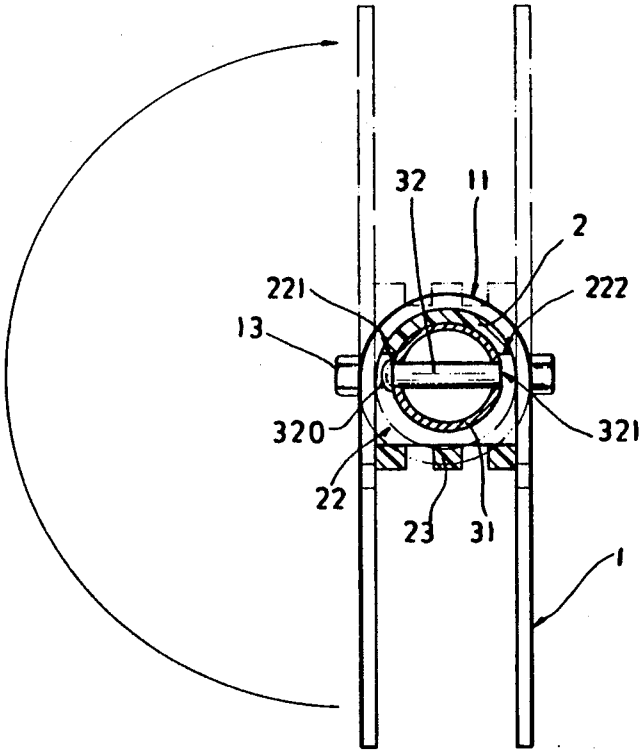
FIG. 4 is a sectional bottom view of the folding joint showing the movement of the base frame on the connecting members.
Figure 5:
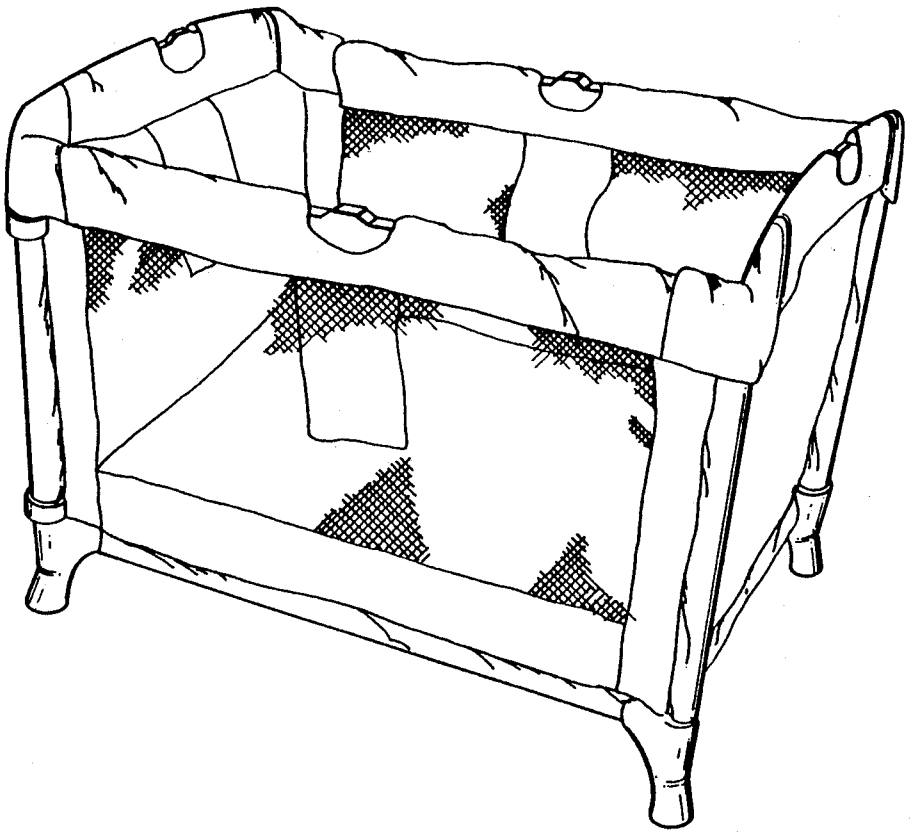
FIG. 5 is an elevational view of a playyard as constructed in accordance with the present invention.

Referring to FIG. 4, when the base frame 1 is disposed in a perpendicular position, the head 320 of the headed pin 32 on the connecting member 2 or 2' is extended outwards and engaged into the through hole 221 or 221' and, the connecting end 31 or 31' of rail 3 or 3' is disposed below the curved bearing surface portion 11 or 11' and prohibited from being rotated upwards. If the base frame 1 is rotated in a clockwise direction through an angle of 180° (see the direction of the arrow in FIG. 4) permitting the head 320 of the headed pin 32 to be moved to and stopped at the other through hole 222 or 222', the connecting end 31 or 31' of the rail 3 or 3' and the connecting member 2 or 2' can be simultaneously rotated upwards.

One of the main feature of the present invention is that the load on the folding joint is distributed through the curved bearing wall portions 11, 11' onto the curved top surface portions 20, 20 of the connecting members 2, 2', i.e., a wider stress area is provided to protect the folding joint against deformation.

I claim:

1. A folding joint comprising a base frame having an inner receiving space, two connecting members respectively pivotally held at two different locations within said inner receiving space, said connecting members respectively holding two cylindrical rails and arranged within said inner receiving space for permitting said rails to be held in a longitudinally aligned position relative to each other and folded up into a collapsed position, said connecting members each having an axial hole at one end thereof for receiving either said rail, opposite side walls respectively having first and second circular through holes, and a track connecting said first and second through holes through said axial hole; and said rails each having a connecting end inserted into said axial hole, said connecting end having a pin hole arranged in a transverse direction relative to said axial hole and a headed pin received in said pin hole, said headed pin having a terminal end flush with an outer wall surface of said connecting end and a head protruding out of said outer wall surface of said connecting end, wherein one of said first and second through holes has an inner diameter approximately equal to a width of said track for passing said headed pin therethrough, and said connecting end rotates through said track permitting said head of said headed pin to be stopped at said first through hole when said rails are held in said longitudinally aligned position and at said second through hole when said rails are folded up into said collapsed position.

* * * * *